US006089138A

United States Patent [19]

Langenegger et al.

[11] Patent Number: 6,089,138

[45] **Date of Patent: *Jul. 18, 2000**

[54] ROTATING, DRIVABLE CUTTER

[75] Inventors: Daniel Langenegger, Strengelbach, Switzerland; Joerg Schoenenberger, Stuttgart, Germany

[73] Assignee: Grapha-Holding AG, Hergiswil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,919

[22] PCT Filed: May 23, 1996

[86] PCT No.: PCT/CH96/00200

§ 371 Date: Jan. 22, 1997

§ 102(e) Date: Jan. 22, 1997

[87] PCT Pub. No.: WO96/38271

PCT Pub. Date: Dec. 5, 1996

[30] Foreign Application Priority Data

May 30, 1995 [CH] Switzerland ..... 1582/95

[51] Int. Cl.[7] ..... B27B 33/02

[52] U.S. Cl. ..... 83/839; 83/840; 83/844; 83/934

[58] Field of Search ..... 83/839, 840, 844, 83/665, 675, 676, 855, 854, 934; 407/35, 33, 36

[56] References Cited

U.S. PATENT DOCUMENTS

| | | | |
|---|---|---|---|
| 1,150,555 | 8/1915 | Thau | 407/35 |
| 1,650,290 | 11/1927 | Metzger | 407/35 |
| 1,728,264 | 9/1929 | England | 407/36 |
| 1,861,928 | 6/1932 | Loeffelman | 407/35 X |
| 1,879,574 | 9/1932 | Sproul | 407/35 |
| 3,706,252 | 12/1972 | Hawkes et al. | 83/934 X |
| 3,726,167 | 4/1973 | Barbour, Jr. | 83/934 X |
| 3,828,409 | 8/1974 | Aspinwall | 29/105 A |
| 3,990,337 | 11/1976 | Barbour, Jr. | 83/934 X |
| 4,132,138 | 1/1979 | Miyamoto | 83/934 X |
| 4,303,113 | 12/1981 | Anderson | 407/47 X |
| 4,418,593 | 12/1983 | Frydel | 407/86 |
| 4,480,518 | 11/1984 | Futterer | 83/934 X |
| 4,840,098 | 6/1989 | Gammerler | 83/675 X |
| 5,165,319 | 11/1992 | Snyder et al. | 83/665 X |
| 5,367,928 | 11/1994 | Geiser et al. | 83/676 X |

FOREIGN PATENT DOCUMENTS

| | | |
|---|---|---|
| 3413615 | 10/1985 | Germany . |
| 3536989 | 4/1987 | Germany . |
| 3719721 | 12/1988 | Germany . |

*Primary Examiner*—M. Rachuba
*Attorney, Agent, or Firm*—Venable; George H. Spencer; Ashley J. Wells

[57] ABSTRACT

A cutter rotatably drivable about a rotational axis for cutting articles including printed products and lengths of flexible materials including paper, plastic, fabric, leather, and metal, includes a drive shaft; a circular knife holder which has a hub, which is removably connected to the drive shaft, and which has defined therein a plurality of guide grooves having a dovetail shape; a plurality of knives which are adjustably positioned within respective guide grooves, which are distributed across the circular knife holder, which have a clamping cross section that is movable within the guide grooves and is locked in place, which project beyond the circumference of the circular knife holder, and which have respective knife ends projecting beyond the circumference of the knife holder and forming a cutting plane that is perpendicular to the rotational axis of the cutter; and a clamping arrangement which extends conically from the hub to the circumference of the circular knife holder, which includes a clamping plate positioned between pairs of adjacent knives, which fastens each respective pair of adjacent knives to one another and to the knife holder in tightenable engagement.

7 Claims, 1 Drawing Sheet

ROTATING, DRIVABLE CUTTER

BACKGROUND OF THE INVENTION

1. Field of The Invention

The invention concerns a rotating, drivable cutter for the cutting of printed products or lengths of flexible materials, such as paper, plastic, fabric, leather or metal.

2. Background Of The Related Art

Such a cutter is disclosed in DE - B - 37 19 721 in which a knife holder is formed at the rear side facing away from the cutting plane by a ring-shaped surface that slopes toward the outside. The cutting knives are arranged on the ring-shaped surface in guide grooves such that they can be moved and fixed in place with respect to the cutting plane. The cutting knives are fixed in place with screws that project through a slot in the knife shank and fit flush against the latter with the head. The cutting force is absorbed in part by the screws as bending and shearing forces, and the shank of the cutting knife is weakened considerably by the slot so that this a design is inadequate per se.

It is the object of the invention at hand to create a cutter of the aforementioned type for which the disadvantages mentioned have been corrected, in which the guide grooves are protected, and which permits a faster knife replacement.

SUMMARY OF THE INVENTION

The solution according to the invention is a rotatably driven cutter for the cutting of printed products or lengths of flexible materials, such as paper, plastic, fabric, leather or metal, composed of a circular knife holder, which is connected removably to a drive shaft and has knives that are distributed across and project over the circumference and can be adjusted in guide grooves, which are fastened to a clamping arrangement that extends conically from the hub to the circumference of the knife holder, wherein the knife ends that project at the circumference for the knife holder form a cutting plane that is perpendicular to the rotational axis of the cutter, characterized in that the knives have a clamping cross section that can be moved in dovetail-shaped guide grooves and can each be locked in place in pairs by a clamping plate that is arranged between them and which can be tightened against the knife holder. The clamping cross section for the shank remains constant.

BRIEF DESCRIPTION OF THE DRAWING

The invention is explained in the following with the aid of an exemplary embodiment and by referring to the drawing, to which reference is made with respect to all details not explained further in the description. The drawing shows.

DESCRIPTION OF THE PREFERRED EMBODIMENTS

Figure 2:
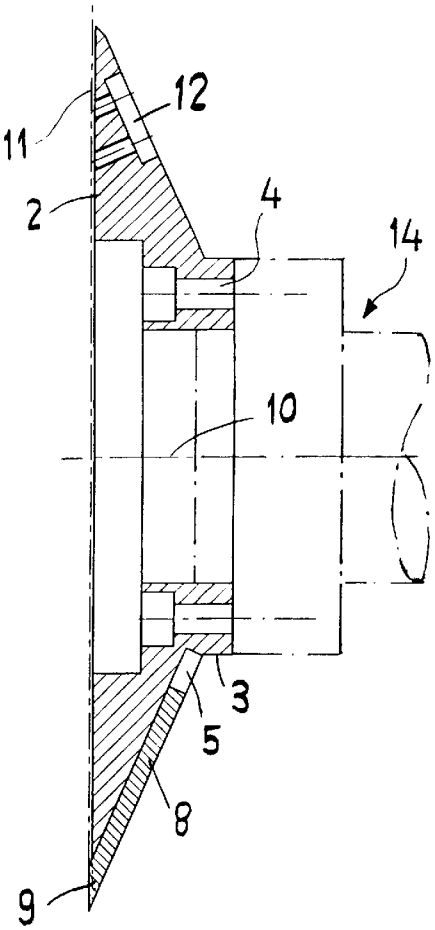
FIG. 2 a cross section of the cutter along the line II—II in FIG. 1.
Figure 1:
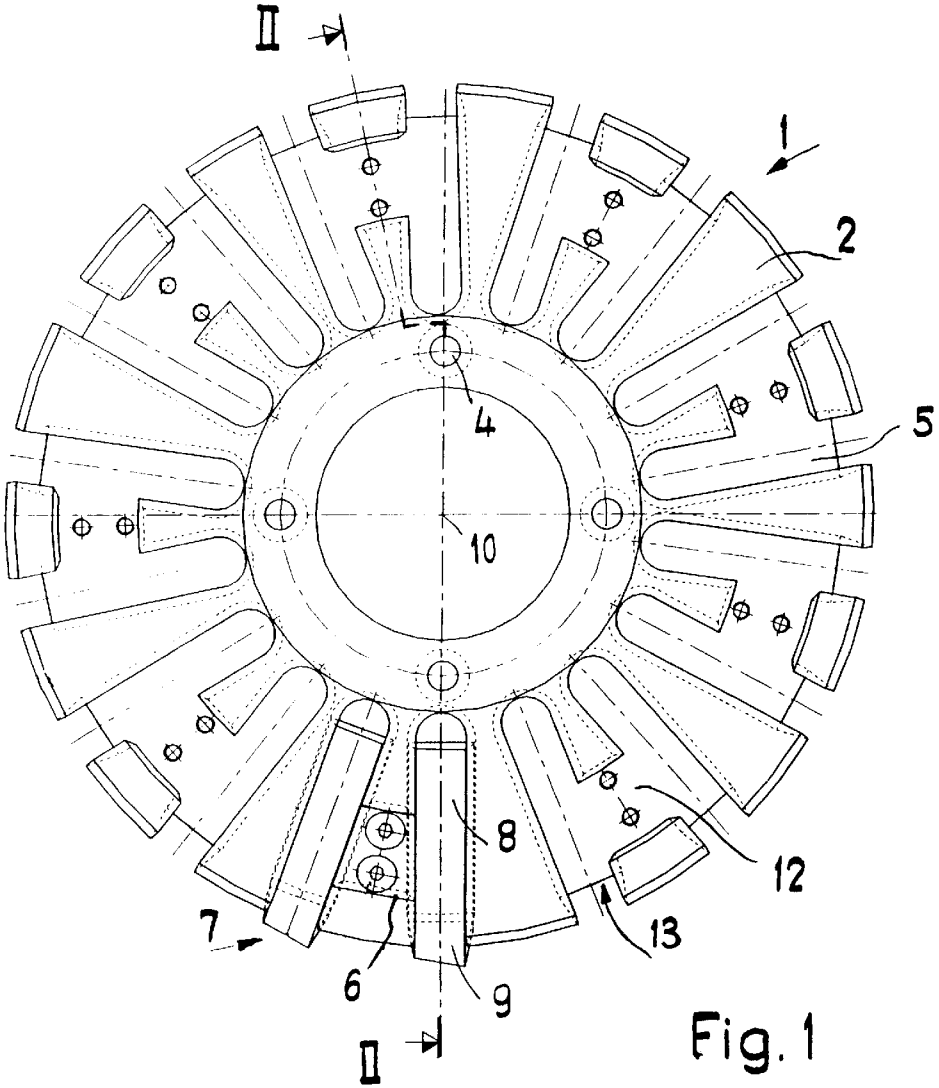
FIG. 1 a frontal view of a cutter.

FIGS. 1 and 2 show a rotating, driven cutter 1 for cutting single or multiple page printed products or material lengths, which comprises a circular knife holder 2 having a hub 3 which is mounted to a drive shaft 14 for a gear such that it can be detached again. Through holes 4 for screws are provided for this. A conical surface extends from hub 3 in a radial direction toward the circumference of the knife holder 2, on which radially extending guide grooves 5 are provided that are distributed over the circumference and end in front of hub 3.

One pair of guide grooves 5 with a clamping plate 6 in between form a clamping arrangement for the cutting knives 7. Cutting knifes 7 can be moved in the guide grooves 5 and are clamped in by their shank 8.

The shank 8 of the cutting knife 7 has a trapezoid cross section, so that it fits longitudinally displaceably into the dovetailed guide groove 5.

Ends 9 of cutting knives 7 project over the circumference of the knife holder 2 and form a cutting plane 11, which is located in front of the face of knife holder 2 and runs perpendicular to the rotational axis 10 of the cutter 1.

In conformance to the guide grooves 5 or cutting knives 7, which are here arranged at a pointed angle, the clamping plate 6 is designed in a trapezoid shape with the same angle and is connected to the knife holder 2 through a fastening device and two screws. The clamping plate 6, which is tapered toward the rotational axis 10, rests with the slanted trapezoid surfaces against the inclined complementary surfaces of the shanks 8 of two knives 7 that are facing it, and pushes these into the guide grooves 5 if the screws are tightened. The thereby created frictional interlocking between the shanks 8 for knives 7 and guide grooves 5 prevents excess stress on the locking screws in the clamping plate 6.

The fastening device for the clamping plate 6 is formed in the drawing by a recess 12, the base of which forms a level surface with the neighboring guide grooves 5. Insofar as the shanks 8 of the knives 7 project sufficiently high over the guide grooves 5, it would be possible to omit the recess 12 between two guide grooves 5.

However, the recesses 12, which interrupt the guide grooves 5 respectively on one side favor an advantageous, narrow cross-sectional shape in the circumferential range of the knife holder 2.

Thus, a fastening device is provided between the guide grooves 5 and is assigned to the clamping plate 6. The fastening device has a recess 12 that is deeper as compared to the tightened clamping plate 6. The recess 12 and the neighboring bases for the guide grooves 5 form an at least approximately level surface. The guide grooves 5 are arranged radially to the rotational axis 10 for the knives 7. The knives 7 in the working position are respectively clamped into the guide element 13 for two neighboring guide grooves 5, which faces away from the clamping plate 6. The clamping plate 6, for which the cross section tapers toward the rotational axis 10, has side edges that correspond to the guide grooves 5 and knives 7, respectively.

What is claimed is:

1. A cutter rotatably drivable about a rotational axis for cutting articles, comprising:

a drive shaft;

a circular knife holder which has a hub, which is removably connected to the drive shaft, and which has defined therein a plurality of guide grooves having a dovetail shape;

a plurality of knives which are adjustably positioned within respective guide grooves of the plurality of guide grooves, which are distributed across the circular knife holder, which have a clamping cross section that is movable within the guide grooves and is locked in place, which project beyond the circumference of the circular knife holder, and which have respective knife ends projecting beyond the circumference of the knife holder and forming a cutting plane that is perpendicular to the rotational axis of the cutter; and a clamping arrangement which extends conically from the hub to the circumference of the circular knife holder, which includes a clamping plate positioned between pairs of adjacent knives, and which fastens each respective pair of adjacent knives to one another and to the knife holder in tightenable engagement.

2. The cutter according to claim 1, wherein the clamping arrangement further includes a fastening device provided between the guide grooves for fastening the clamping plate to the knife holder.

3. The cutter according to claim 2, wherein the fastening device has defined therein a recess provided at a level that is deeper than that of the clamping plate after tightening.

4. The cutter according to claim 3, wherein the plurality of guide grooves have respective bases, and wherein the recess and the bases of adjacent guide grooves form an approximately level surface.

5. The cutter according to claim 1, wherein the guide grooves are arranged radially from the rotational axis of the cutter.

6. The cutter according to claim 1, wherein two adjacent guide grooves form a guide element which faces away from the clamping plate, and wherein the knives in the working position are respectively clamped into the guide element.

7. The cutter according to claim 1, wherein the clamping plate has a cross section which tapers toward the rotational axis and has side edges that correspond to those of the plurality of guide grooves and the plurality of knives, respectively.

* * * * *